US009936274B2

(12) United States Patent
Meskens et al.

(10) Patent No.: US 9,936,274 B2
(45) Date of Patent: Apr. 3, 2018

(54) SYSTEM AND METHOD FOR PROVIDING A NOTIFICATION OF DEVICE ORIENTATION

(71) Applicant: Cochlear Limited, Macquarie University, NSW (AU)

(72) Inventors: Werner Meskens, Opwijk (BE); Robert G. Bennett, Macquarie University (AU)

(73) Assignee: Cochlear Limited, Macquarie University, NSW (AU)

( * ) Notice: Subject to any disclaimer, the term of this patent is extended or adjusted under 35 U.S.C. 154(b) by 392 days.

(21) Appl. No.: 14/543,093

(22) Filed: Nov. 17, 2014

(65) Prior Publication Data

US 2015/0341729 A1 Nov. 26, 2015

Related U.S. Application Data

(60) Provisional application No. 62/002,289, filed on May 23, 2014.

(51) Int. Cl.

| | |
|---|---|
| ***H04R 25/00*** | (2006.01) |
| ***H04R 1/10*** | (2006.01) |
| ***H04R 3/00*** | (2006.01) |

(52) U.S. Cl.

CPC ..... *H04R 1/10* (2013.01); *H04R 3/005* (2013.01); *H04R 25/40* (2013.01); *H04R 25/405* (2013.01); *H04R 25/554* (2013.01); *H04R 25/606* (2013.01); *H04R 25/305* (2013.01); *H04R 2225/67* (2013.01); *H04R 2499/11* (2013.01)

(58) Field of Classification Search

CPC ..... H04R 1/326; H04R 1/406; H04R 3/005; H04R 25/405; H04R 29/006; H04R 25/552; H04R 25/554; H04R 25/606; H04R 2225/67; H04R 2499/11

USPC ... 381/312, 313, 315, 91, 92, 122, 355, 356, 381/37, 358; 600/25; 607/55, 56, 57

See application file for complete search history.

(56) References Cited

U.S. PATENT DOCUMENTS

| | | | | |
|---|---|---|---|---|
| 4,352,960 | A | 10/1982 | Dormer et al. | |
| 5,949,895 | A | 9/1999 | Ball et al. | |
| 6,560,488 | B1 | 5/2003 | Crawford | |
| 6,633,645 | B2 * | 10/2003 | Bren | H04R 25/43 361/160 |
| 7,369,671 | B2 * | 5/2008 | Sacha | H04R 25/43 381/312 |
| 7,561,700 | B1 * | 7/2009 | Bernardi | H04R 29/006 381/313 |
| 7,571,006 | B2 | 8/2009 | Gordon et al. | |
| 2007/0208403 | A1 | 9/2007 | Della Santina et al. | |

(Continued)

FOREIGN PATENT DOCUMENTS

| | | | |
|---|---|---|---|
| WO | 2007146773 | A1 | 12/2007 |
| WO | 2009056167 | A1 | 5/2009 |

(Continued)

*Primary Examiner* — Huyen D Le

(57) ABSTRACT

A device includes a microphone, a sensor that generates a first signal that is indicative of an orientation of the microphone, and a processor. The processor uses the first signal to determine if the microphone is in a predetermined orientation. Further, the processor, responsive to determining that the microphone is not in the predetermined orientation, generates a second signal that is used to provide a notification that the microphone is not in the predetermined orientation.

23 Claims, 4 Drawing Sheets

(56) References Cited

U.S. PATENT DOCUMENTS

| | | | | |
|---|---|---|---|---|
| 2010/0046778 | A1 | 2/2010 | Crawford et al. | |
| 2012/0197345 | A1 | 8/2012 | Staller | |
| 2013/0064404 | A1 | 3/2013 | Ridler et al. | |
| 2015/0201286 | A1* | 7/2015 | Ridler ..... | H04R 25/405 381/313 |

FOREIGN PATENT DOCUMENTS

| | | | |
|---|---|---|---|
| WO | 2010017118 | A1 | 2/2010 |
| WO | 2010056768 | A1 | 5/2010 |

* cited by examiner

SYSTEM AND METHOD FOR PROVIDING A NOTIFICATION OF DEVICE ORIENTATION

CROSS REFERENCE TO RELATED APPLICATION

The present application claims priority to U.S. Provisional Application No. 62/002,289 filed on May 23, 2014, which is incorporated herein by reference in its entirety.

BACKGROUND

Various types of hearing prostheses provide persons with different types of hearing loss with the ability to perceive sound. Hearing loss may be conductive, sensorineural, or some combination of both conductive and sensorineural. Conductive hearing loss typically results from a dysfunction in any of the mechanisms that ordinarily conduct sound waves through the outer ear, the eardrum, and/or the bones of the middle ear. Sensorineural hearing loss typically results from a dysfunction in the inner ear, such as in the cochlea where sound or acoustic vibrations are converted into neural signals, or any other part of the ear, auditory nerve, or brain that may process the neural signals.

Persons with some forms of conductive hearing loss may benefit from hearing prostheses, such as acoustic hearing aids or vibration-based hearing devices. An acoustic hearing aid typically includes a small microphone to detect sound, an amplifier to amplify certain portions of the detected sound, and a small speaker to transmit the amplified sound into the person's ear. Vibration-based hearing devices typically include a small microphone to detect sound and a vibration mechanism to apply vibrations, which represent the detected sound, directly or indirectly to a person's bone or teeth, thereby causing vibrations in the person's inner ear and bypassing the person's auditory canal and middle ear.

Vibration-based hearing devices include, for example, bone anchored devices, direct acoustic cochlear stimulation devices, and other vibration-based devices. A bone-anchored device typically utilizes a surgically implanted mechanism or a passive connection through the skin or teeth to transmit vibrations via the skull. Similarly, a direct acoustic cochlear stimulation device typically utilizes a surgically implanted mechanism to transmit vibrations, but bypasses the skull and more directly stimulates the inner ear. Other vibration-based hearing devices may use similar vibration mechanisms to transmit acoustic signals via direct or indirect vibration applied to teeth or other cranial or facial structures.

Persons with certain forms of sensorineural hearing loss may benefit from implanted prostheses, such as cochlear implants and/or auditory brainstem implants. Generally, cochlear implants and auditory brainstem implants electrically stimulate auditory nerves in the cochlea or the brainstem to enable persons with sensorineural hearing loss to perceive sound. For example, a cochlear implant uses a small microphone to convert sound into a series of electrical signals, and uses the series of electrical signals to stimulate the auditory nerve of the recipient via an array of electrodes implanted in the cochlea. An auditory brainstem implant can use technology similar to cochlear implants, but instead of applying electrical stimulation to a person's cochlea, the auditory brainstem implant applies electrical stimulation directly to a person's brainstem, bypassing the cochlea altogether.

In addition, some persons may benefit from a bimodal hearing prosthesis that combines one or more characteristics of acoustic hearing aids, vibration-based hearing devices, cochlear implants, or auditory brainstem implants to enable the person to perceive sound.

OVERVIEW

In examples disclosed herein, a hearing prosthesis may include separate components that function together to enable a person to perceive sound. In one example, the hearing prosthesis includes a first component that is configured to be disposed externally to the person and a second component that is configured to be implanted in the person in a generally fixed orientation with respect to the person. The first component may be configured to detect sound with a microphone, to encode the detected sound as acoustic signals, and to deliver the acoustic signals to the second component over a radio frequency (RF) link between the first and second components. Further, the second component may be configured to apply the acoustic signals to stimulate the person's hearing system using amplified sound, vibrations, and/or electrical signals.

The first component may be removably coupled in some manner to the person. For example, the first and/or second components may include one or more magnets that are configured to transcutaneously couple the first component to the second component and, thus, to the person. Generally, the first component is capable of being placed in various orientations or angles with respect to the person. However, it may be useful or desirable to position the first component in a particular orientation or within a particular range of orientations with respect to the person.

For example, the microphone may be a directional microphone that has a direction of maximum sensitivity, and it may be desirable to orient the microphone to focus on sounds from a specific direction, such as generally in front of the person using the hearing prosthesis. This operation of the directional microphone to focus on sounds coming from in front of the person may help the person to perceive and understand sounds that are part of a conversation with another person or that are otherwise coming from a sound source, e.g., a television or radio speaker, that the person is facing.

The person using the hearing prosthesis, however, may not be able to easily or conveniently orient the first component and the microphone to focus on sounds from a front-facing direction. For example, if the first component is a behind-the-ear-type component that is generally symmetrical in shape, it may be difficult for the person to see the orientation of the first component in order to accurately adjust the orientation. In addition, the orientation of the first component may change after being coupled to the person, and the person may not be aware that the orientation has changed.

In accordance with an embodiment of the present disclosure, the first component is configured to determine whether the first component is in a predetermined or desired orientation or range of orientations. For example, the first component can determine whether the first component is in a predetermined orientation so that the directional microphone is focused on sounds coming from in front of the person. Responsive to the first component determining that the orientation of the first component is not in the predetermined orientation, the first component may generate an error signal that can be used to notify the person of a misalignment or orientation error of the first component.

In accordance with an embodiment of the present disclosure, the first component may deliver the error signal to the second component over the RF link between the first and second components, and the second component may apply the error signal to stimulate the person's hearing system using amplified sound, vibrations, and/or electrical signals. As a result, the person can perceive the error signal as sound and, thus, the error signal can notify the person of the misalignment or orientation error. The person can then use the notification of orientation error to help adjust the orientation of the first component.

In addition, the first component may also be configured to determine an extent of error between the orientation of the first component and the predetermined orientation or range of orientations. In accordance with an embodiment of the present disclosure, the first component may generate an error signal that is indicative of the extent of orientation error. For example, the first component may vary one or more attributes (e.g., signal pattern, frequency, amplitude, and the like) of the error signal in accordance with the extent of orientation error. Accordingly, the error signal itself may be used to indicate the presence of an error in the orientation of the first component, and the attribute(s) of the error signal may be used to indicate an extent of the error.

Generally, the first component may include one or more of a variety of sensors configured to determine the orientation of the first component with respect to the second component and/or with respect to a person using the components. For instance, the sensor(s) may include one or more of an accelerometer, a gyroscope, a Hall sensor, a tilt sensor, an inductor, a light sensor, a polarized antenna, and/or a proximity sensor.

DETAILED DESCRIPTION

The following detailed description sets forth various features and functions of the disclosed embodiments with reference to the accompanying figures. In the figures, similar reference numbers typically identify similar components, unless context dictates otherwise. The illustrative embodiments described herein are not meant to be limiting. Aspects of the disclosed embodiments can be arranged and combined in a variety of different configurations, all of which are contemplated by the present disclosure. For illustration purposes, some features and functions are described with respect to medical devices, such as hearing prostheses. However, the features and functions disclosed herein may also be applicable to other types of devices, including other types of medical and non-medical devices.

Figure 1:
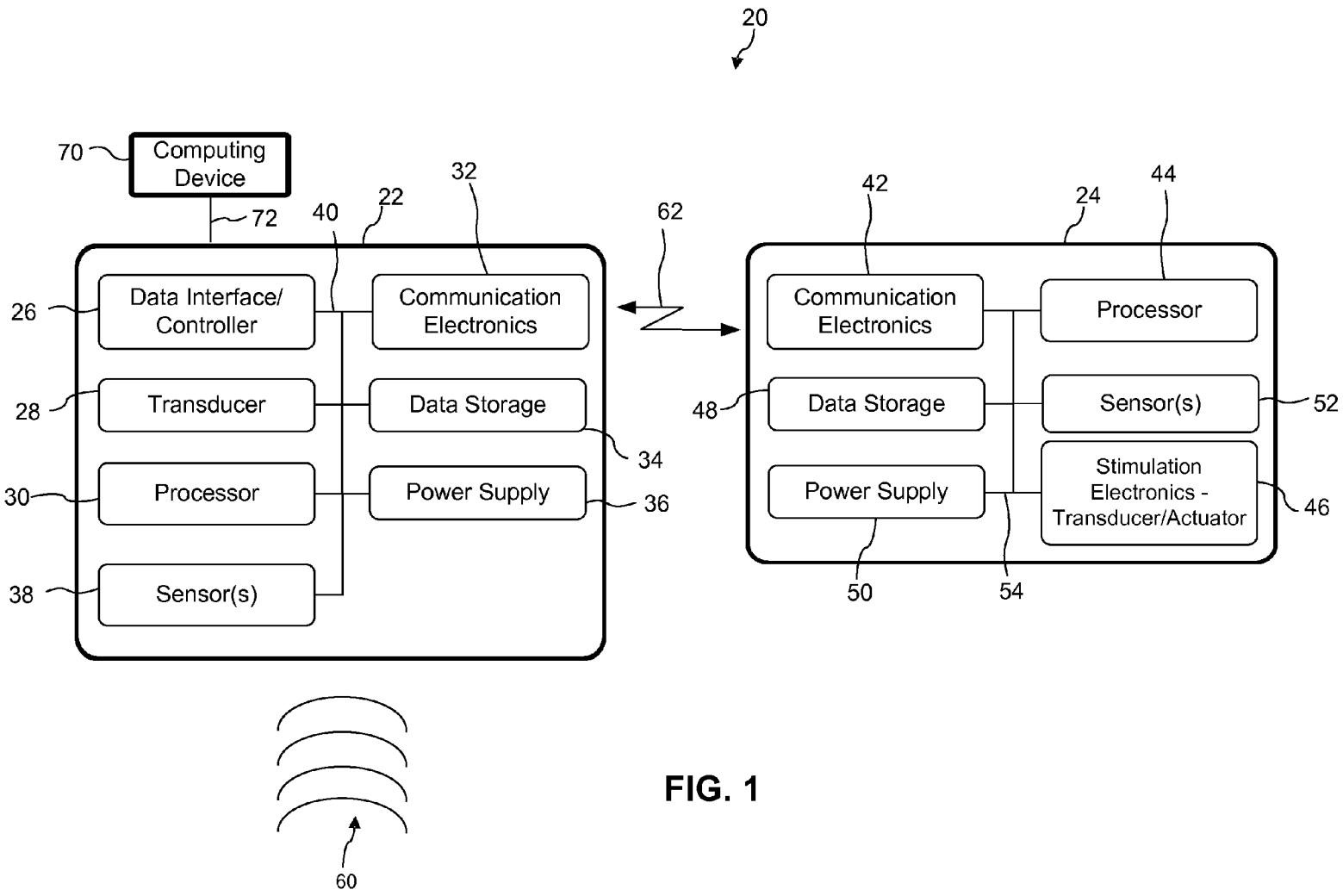
FIG. 1 is a block diagram of a hearing prosthesis according to an embodiment of the present disclosure.

Referring now to FIG. 1, an example electronic device 20 includes a first component 22 and a second component 24. The device 20 can be a hearing prosthesis, such as a cochlear implant, an acoustic hearing aid, a bone-anchored device, a direct acoustic cochlear stimulation device, an auditory brainstem implant, a bimodal hearing prosthesis, or any other type of hearing prosthesis configured to assist a prosthesis recipient to perceive sound. In this context, the first component 22 can be generally external to a recipient and communicate with the second component 24, which can be implanted in the recipient. In other examples, the components 22, 24 can both be at least partially implanted or can both be at least partially external to the recipient. In yet other examples, the first and second component 22, 24 may form separate components or units of a single operational device. Generally, an implantable component or device can be hermetically sealed and otherwise adapted to be at least partially implanted in a person.

In FIG. 1, the first component 22 includes a data interface or controller 26 (such as a universal serial bus (USB) controller), one or more transducers 28, a processor 30 (such as digital signal processor (DSP)), radio electronics 32 (such as an electromagnetic radio frequency (RF) transceiver), data storage 34, a power supply 36, and one or more sensors 38, all of which are illustrated as being coupled directly or indirectly via a wired conductor or wireless link 40. In the example of FIG. 1, the second component 24 includes radio electronics 42 (such as another RF transceiver), a processor 44, stimulation electronics 46, data storage 48, a power supply 50, and one or more sensors 52 all of which are illustrated as being coupled directly or indirectly via a wired conductor or wireless link 54.

The transducer 28 may include a microphone that is configured to receive external acoustic signals 60. Further, the microphone may include combinations of one or more omnidirectional or directional microphones that are configured to receive background sounds and/or to focus on sounds from a specific direction, such as generally in front of the prosthesis recipient. Alternatively or in conjunction, the device 20 may be configured to receive sound information from other sources, such as electronic sound information received through the data interface 26 of the first component 22 or from the radio electronics 42 of the second component 24.

In one example, the processor 30 of the first component 22 is configured to convert or encode the acoustic signals 60 (or other electronic sound information) into encoded acoustic signals and to apply the encoded acoustic signals to the radio electronics 32. In the present example, the radio electronics 32 of the first component 22 are configured to transmit the encoded acoustic signals as output signals 62 to the radio electronics 42 of the second component 24. Illustratively, the radio electronics 32, 42 can include magnetically coupled coils that establish an RF link between the units 22, 24. Accordingly, the radio electronics 32 can transmit the output signals 62 encoded in a varying or alternating magnetic field over the RF link between the components 22, 24.

Generally, the radio electronics 32 can include an RF inductive transmitter system or circuit. Such a transmitter system may further include an RF modulator, a transmitting coil, and associated circuitry for driving the coil to radiate the output signals 62 as electromagnetic RF signals. Illustratively, the RF link can be an On-Off Keying (OOK) modulated 5 MHz RF link, although different forms of modulation and signal frequencies can be used in other examples.

As mentioned above, the processor 30 is configured to convert the acoustic signals 60 into encoded acoustic signals and to transmit the encoded acoustic signals as the output signals 62 to the radio electronics 42. In particular, the processor 30 may utilize configuration settings, auditory processing algorithms, and a communication protocol to convert the acoustic signals 60 into acoustic stimulation data and to encode the acoustic stimulation data in the output signals 62. One or more of the configuration settings, auditory processing algorithms, and communication protocol information can be stored in the data storage 34. Illustratively, the auditory processing algorithms may utilize one or more of speech algorithms, filter components, or audio compression techniques. The output signals 62 can also be used to supply power to one or more components of the second component 24.

The second component 24 can then apply the acoustic stimulation data to the stimulation electronics 46 to allow a recipient to perceive the acoustic signals 62 as sound. Generally, the stimulation electronics 46 can include a transducer or actuator that provides auditory stimulation to the recipient through one or more of electrical nerve stimulation, audible sound production, or mechanical vibration of the cochlea, for example.

In the present example, the communication protocol defines how the stimulation data is transmitted from the first component 22 to the second component 24. For example, the communication protocol can be an RF protocol that the first component applies after generating the stimulation data, to define how the stimulation data will be encoded in a structured signal frame format of the output signals 62. In addition to the stimulation data, the communication protocol can define how power signals are supplied over the structured signal frame format to provide a more continuous power flow to the second component 24 to charge the power supply 50, for example. Illustratively, the structured signal format can include output signal data frames for the stimulation data and additional output signal power frames.

Once the stimulation data and/or power signals are encoded using the communication protocol, the encoded stimulation data and/or power signals can be provided to the radio electronics 32, which can include an RF modulator. The RF modulator can then modulate the encoded stimulation data and/or power signals with the carrier signal, e.g., a 5 MHz carrier signal, and the modulated 5 MHz carrier signal can then be transmitted over the RF link from the radio electronics 32 to the radio electronics 40. In various examples, the modulations can include OOK or frequency-shift keying (FSK) modulations based on RF frequencies between about 100 kHz and 50 MHz.

The second component 24 may then receive the RF output signals 62 via the radio electronics 42. In one example, the radio electronics 42 include a receiving coil and associated circuitry for receiving electromagnetic RF signals, such as the output signals 62. The processor 44 is configured to then decode the output signals 62 and extract stimulation data. And the processor 44 can then apply the stimulation data to the recipient via the stimulation electronics 46. Further, when the output signals 62 include power signals, the radio electronics 42 are configured to apply the received output signals 62 to charge the power supply 50.

As described above, the radio electronics 32 can be configured to transmit data and power to the radio electronics 42. Likewise, the radio electronics 42 can be configured to transmit signals to the radio electronics 32, and the radio electronics 32 can be configured to receive signals from the second component 24 or other devices or components.

In accordance with an embodiment of the present disclosure, the processor 30 of the first component 22 is also configured to determine an orientation of the first component with respect to a frame of reference. The frame of reference can be the second component 24 and/or a person that is using the device 20, such as a person in whom the second component is implanted. In this embodiment, the processor 30 is configured to use a signal from one or more of the sensors 38, 52 to determine an orientation of the first component. More particularly, the processor 30 can use the signal from the sensors 38, 52 to determine an orientation of the microphone 28 with respect to the second component 24 and/or with respect to the person that is using the device.

After the processor 30 determines the orientation of the first component 22, the processor may then compare the determined orientation with a desired or predetermined orientation or range of orientations. If the determined orientation of the first component 22 does not match the predetermined orientation, the processor is configured to generate an orientation error signal that can be transmitted by the radio electronics 32 of the first component to the radio electronics 42 of the second component 24. The second component 24 may then apply the orientation error signal to the stimulation electronics 46 to allow the recipient or person to perceive the orientation error as sound, such as a distinctive chirp or beeping sound. Accordingly, the device 20 can notify the person of the orientation error in the positioning of the first component 22.

Further, the processor 30 may compare the determined orientation with the predetermined orientation to determine an extent of orientation error. The processor 30 may then modify an attribute (e.g., signal pattern, frequency, amplitude, and the like) of the error signal in accordance with the extent of orientation error. Accordingly, when the second component 24 applies the error signal to the stimulation electronics 46, the person can perceive the attribute(s) of the error signal as an indication of the extent of the error. Illustratively, an increasing frequency or amplitude of the orientation error signal may indicate a greater orientation error. Other examples are also possible and contemplated by the present disclosure.

A variety of sensors 38, 52 may be suitable for allowing the processor 30 to determine the orientation of the first component 22 with respect to a frame of reference, such as the second component 24 and/or the person that is using the device. Generally, when the second component 24 is implanted in a substantially fixed position in the person, the processor 30 can determine the orientation of the first component 22 with respect to the second component and then calculate the orientation of the first component 22 with respect to the second component.

For instance, the sensor may include one or more of an accelerometer, a gyroscope, a tilt sensor, and the like that is configured to sense an angle of the first component 22 with respect to the gravitational force of the earth. Generally, when a person is standing and facing a sound source, the gravitational force of the earth is approximately orthogonal to the direction that the person is facing. The processor 30 can use this general relation between the gravitational force and the direction that a person is facing while standing to determine the orientation of the first component with respect to the person. Further, the processor may use a signal from an accelerometer or other movement sensor to determine a direction that the person is moving and, thus, to determine a direction that the person is likely facing.

In another example, the sensors 38, 52 may include a Hall sensor that can be used to detect a magnetic field that originates from the first component, the second component, another separate component (e.g., a magnetic earing or piercing worn by the person), and/or some other frame of reference. The Hall sensor and the magnetic field can be configured such that the Hall sensor will only detect the magnetic field when the first component 22 is in a predetermined, desired orientation with respect to the second component 24 and/or the person. Alternatively, the Hall sensor and the magnetic field can be configured such that the Hall sensor will only detect the magnetic field when the first component 22 is not in the predetermined, desired orientation with respect to the second component 24 and/or the person. The Hall sensor and magnetic field can also be configured such that the Hall sensor is able to measure the magnetic field to define the orientation of the first component. A Hall sensor can also be used to detect the presence of a magnetic field from a magnet that is included in the other component. The detection of the magnet can be used as a switch to cause the processor 30 to perform various functions, such as determining the orientation of the first component and determining the orientation error.

The sensors 38, 52 may also include inductor components, such as a wire-wrapped ferrite rod or an air inductor, for detecting a variable or alternating magnetic field. Generally, the alternating magnetic field may be generated by a source in the second component, in another device worn by the person, and/or at some other reference point. The inductor components and the alternating magnetic field can be configured to use directions of the magnetic field lines to define the orientation of the first component.

In a further example, the sensors 38, 52 may include polarized antenna components for measuring signal strength of a polarized electromagnetic (EM) field. Generally, the polarized EM field may be generated by a source in the second component, in another device worn by the person, and/or at some other reference point. The polarized antenna components and the polarized EM field can be configured to measure signal strength of the EM field to define the orientation of the first component.

In yet other examples, suitable sensors 38, 52 may include light sensing components, proximity sensing components, telecoil ciruitry, and the like. For instance, a light sensing component can be used to detect light conditions that are consistent with the predetermined orientaiton, which may be characterized by brighter areas above and less bright areas below the first component. In the example of a proximity sensing component, the sensor can detect distances to reference points, such as the person's ear or shoulder, that are consistent with the predetermined orientation.

As discussed above, the processor 30 of the first component may be used to determine an orientation of the first component and to determine an orientation error of the first component. In other examples, the processor 44 of the second component 24 can be used alternatively or in combination with the processor 30 to determine the orientation of the first component and to determine an orientation error of the first component.

Figure 2A:
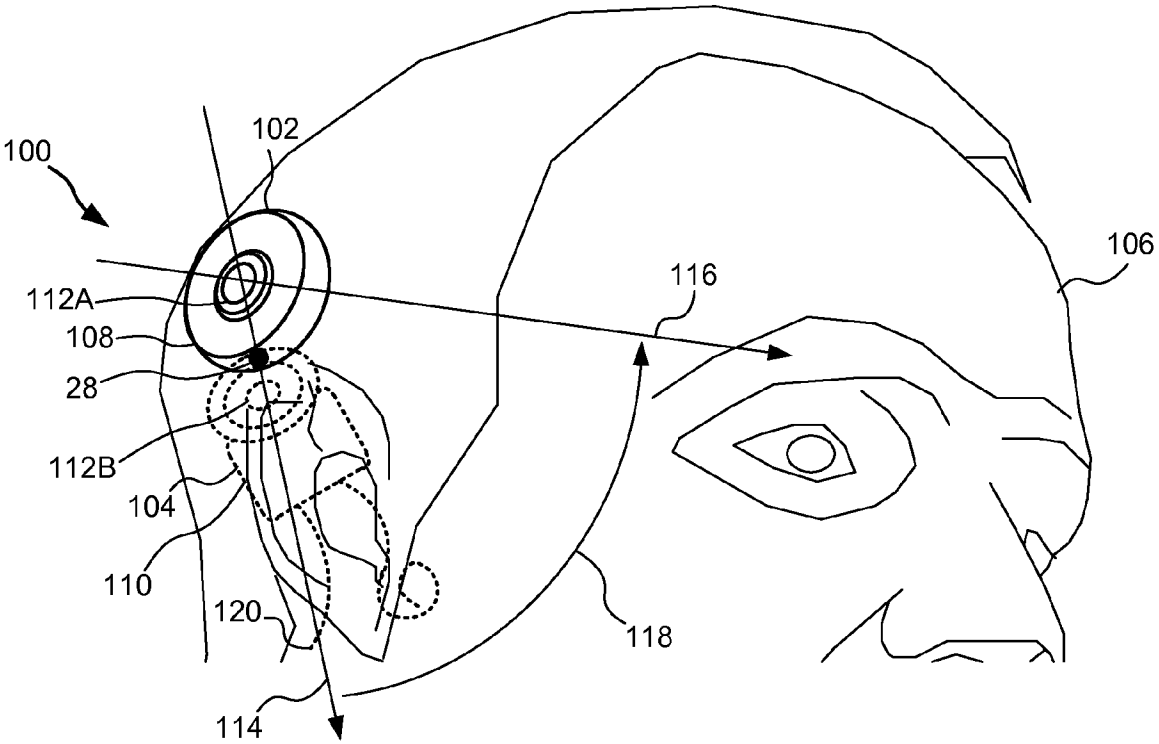
FIGS. 2A-2B illustrate partially cut-away, isometric views of a hearing prosthesis coupled to a recipient in accordance with an embodiment of the present disclosure.
Figure 2B:
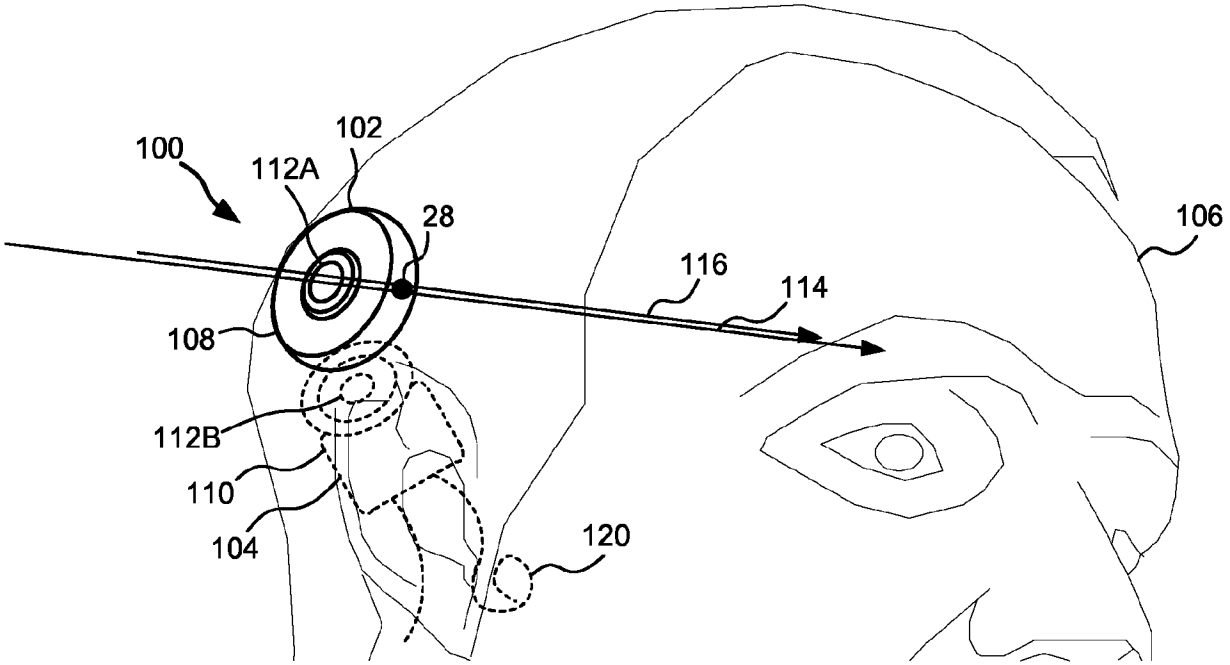

In the embodiment illustrated in FIGS. 2A-2B, an example hearing prosthesis 100 is shown coupled to a recipient's hearing system. In FIGS. 2A-2B, an external sound processor 102 corresponds to the first component 22, and an implantable component 104 that is implanted in a person 106 corresponds to the second component 24. As illustrated, the sound processor 100 includes a generally symmetrical housing 108 (e.g., a circular housing) that partially or fully encloses various other components, such as the components shown in FIG. 1. The implantable component 104 may also include a housing 110 that hermetically seals various components, such as the component shown in FIG. 1.

The sound processor 102 and the implantable component 104 may also include a mechanism for coupling the sound processor with the implantable component. In one example, the coupling mechanism may use one or more magnets 112 that are included in one or more of the sound processor 102 or the implantable component 104. Illustratively, the sound processor 102 may include a single magnet 112A and the implantable component may include a single magnet 112B. In this example, the magnet 112A can be removably coupled to the magnet 112B. The use of a single magnet in one (or each) of the sound processor and the implantable component may be useful to efficiently utilize the relatively small space in the components, as compared to other coupling mechanisms that may include multiple magnets in each component. Other coupling mechanisms are also possible.

In FIGS. 2A-2B, an orientation of the sound processor 102 is represented by an arrow 114, which in the present example extends generally in a plane aligned with the side of the person's face/ear and downwardly toward the person's feet. In one example, the orientation of the sound processor corresponds to a direction of maximum sensitivity of a microphone 28 that is included with the sound processor. FIGS. 2A-2B also illustrate an arrow 116 that represents a predetermined or desired orientation of the sound processor, which in the present example extends generally in a plane aligned with the side of the person's face/ear and in a forward-facing direction. In FIG. 2A, the orientation of the sound processor 102 (represented by the arrow 114) is not aligned with the desired orientation (represented by the arrow 116). Further, in FIG. 2A, an arrow 118 represents an extent of orientation error between the orientation of the sound processor 102 and the desired orientation.

As discussed above, the sound processor 102 and/or the implantable component 104 may be configured to determine the orientation of the sound processor 102 and to generate an orientation error signal if the sound processor 102 is not in the predetermined orientation. The orientation error signal may also be indicative of the extent of orientation error. The sound processor 102 may then transmit the orientation error signal to the implantable component 104, and the implantable component may apply the orientation error signal to stimulation electronics 120 (e.g., an electrode assembly) to notify the person 106 of the orientation error. The person 106 can then adjust the sound processor 102 so to be in the desired orientation, as illustrated in FIG. 2B (arrow 114 is aligned with arrow 116, which is shown slightly offset from arrow 114 for clarity).

When the sound processor 102 is in the desired orientation, the sound processor may discontinue generating and transmitting the orientation error signal. Although, in another example, when the sound processor 102 is moved to the desired orientation, the sound processor may generate a confirmation signal that can be transmitted to the internal component 104 and applied to the stimulation electronics 46 to notify the person that the sound processor is in the desired orientation. In this example, the orientation error signal and the confirmation signal are different from each other so that the person can distinguish the different notifications.

Referring back to the stimulation electronics 46 of FIG. 1, these electronics can take various forms depending on the type of hearing prosthesis. Illustratively, in embodiments where the hearing prosthesis 20 is a direct acoustic cochlear stimulation (DACS) device, the microphone 28 is configured to receive the acoustic signals 60, and the processor 30 is configured to encode the acoustic signals into the output signals 62. In this example, the radio electronics 42 receive the output signals 62, and the processor 44 applies the output signals to the DACS recipient's inner ear via the stimulation electronics 46. In the present example, the stimulation electronics 46 includes or is otherwise connected to an auditory nerve stimulator to transmit sound to the recipient via direct mechanical stimulation.

Similarly, for embodiments where the hearing prosthesis 20 is a bone-anchored device, the microphone 28 and the processor 30 are configured to receive, analyze, and encode acoustic signals 60 into the output signals 62. The radio electronics 42 receive the output signals 62, and the processor 44 applies the output signals to the bone anchored device recipient's skull via the stimulation electronics 46 that includes or is otherwise connected to an auditory vibrator to transmit sound to the recipient via direct bone vibrations, for example.

In addition, for embodiments where the hearing prosthesis 20 is an auditory brain stem implant, the microphone 28 and the processor 30 are configured to receive, analyze, and encode the acoustic signals 60 into the output signals 62. The radio electronics 42 receive the output signals 62, and the processor 44 applies the output signals to the auditory brain stem implant recipient's auditory nerve via the stimulation electronics 46 that, in the present example, includes or is otherwise connected to one or more electrodes.

Similarly, in embodiments where the hearing prosthesis 20 is a cochlear implant, the microphone 28 and the processor 30 are configured to receive, analyze, and encode the external acoustic signals 60 into the output signals 62. The radio electronics 42 receive the output signals 62, and the processor 44 applies the output signals to an implant recipient's cochlea via the stimulation electronics 46. In this example, the stimulation electronics 46 includes or is otherwise connected to an array of electrodes.

In embodiments where the hearing prosthesis 20 is an acoustic hearing aid or a combination electric and acoustic hybrid hearing prosthesis, the microphone 28 and the processor 30 are configured to receive, analyze, and encode acoustic signals 60 into output signals 62. The radio electronics 42 receive the output signals 62, and the processor 44 applies the output signals to a recipient's ear via the stimulation electronics 46 comprising a speaker, for example.

Referring now to the power supply 36 and the power supply 50, each power supply provides power to various components of the first and second components 22, 24, respectively. The power supplies 36, 50 can be any suitable power supply, such as non-rechargeable or rechargeable batteries. In one example, one or more both of the power supplies 36, 50 are batteries that can be recharged wirelessly, such as through inductive charging. Generally, a wirelessly rechargeable battery facilitates complete subcutaneous implantation of a device to provide fully or at least partially implantable prostheses. A fully implanted hearing prosthesis has the added benefit of enabling the recipient to engage in activities that expose the recipient to water or high atmospheric moisture, such as swimming, showering, saunaing, etc., without the need to remove, disable or protect, such as with a water/moisture proof covering or shield, the hearing prosthesis. A fully implanted hearing prosthesis also spares the recipient of stigma, imagined or otherwise, associated with use of the prosthesis.

Referring to the data storage 34 and the data storage 48, these components generally include any suitable volatile and/or non-volatile storage components. Further, the data storage 34, 48 may include computer-readable program instructions and perhaps additional data. In some embodiments, the data storage 34, 48 stores data and instructions used to perform at least part of the herein-described processes and/or at least part of the functionality of the systems described herein. Although the data storage 34, 48 in FIG. 1 are illustrated as separate blocks, in some embodiments, the data storage can be incorporated, for example, into the processor(s) 30, 44, respectively.

The device 20 illustrated in FIG. 1 further includes a computing device 70 that is configured to be communicatively coupled to the first component 22 (and/or the second component 24) via a connection or link 72. The link 72 may be any suitable wired connection, such as an Ethernet cable, a Universal Serial Bus connection, a twisted pair wire, a coaxial cable, a fiber-optic link, or a similar physical connection, or any suitable wireless connection, such as Bluetooth, Wi-Fi, WiMAX, inductive or electromagnetic coupling or link, and the like.

In general, the computing device 70 and the link 72 are used to operate the device 20 in various modes. In a first example mode, the computing device 70 is used to develop and/or load a recipient's configuration data to the device 20, such as through the data interface 26. In another example mode, the computing device 70 is used to upload other program instructions and firmware upgrades, for example, to the device 20. In yet other example modes, the computing device 70 is used to deliver data (e.g., sound information or the predetermined orientation data) and/or power to the device 20 to operate the components thereof and/or to charge one or more of the power supplies 36, 50. Still further, various other modes of operation of the prosthesis 20 can be implemented by utilizing the computing device 70 and the link 72.

The computing device 70 can further include various additional components, such as a processor and a power source. Further, the computing device 70 can include a user interface or input/output devices, such as buttons, dials, a touch screen with a graphical user interface, and the like, that can be used to turn the one or more components of the device 20 on and off, adjust the volume, switch between one or more operating modes, adjust or fine tune the configuration data, etc.

Various modifications can be made to the device 20 illustrated in FIG. 1. For example, a user interface or input/output devices can be incorporated into the first component 22 or the second components 24. In another example, the second components 24 can include one or more microphones. Generally, the device 20 may include additional or fewer components arranged in any suitable manner. In some examples, the device 20 may include other components to process external audio signals, such as components that measure vibrations in the skull caused by audio signals and/or components that measure electrical outputs of portions of a person's hearing system in response to audio signals.

Figure 3:
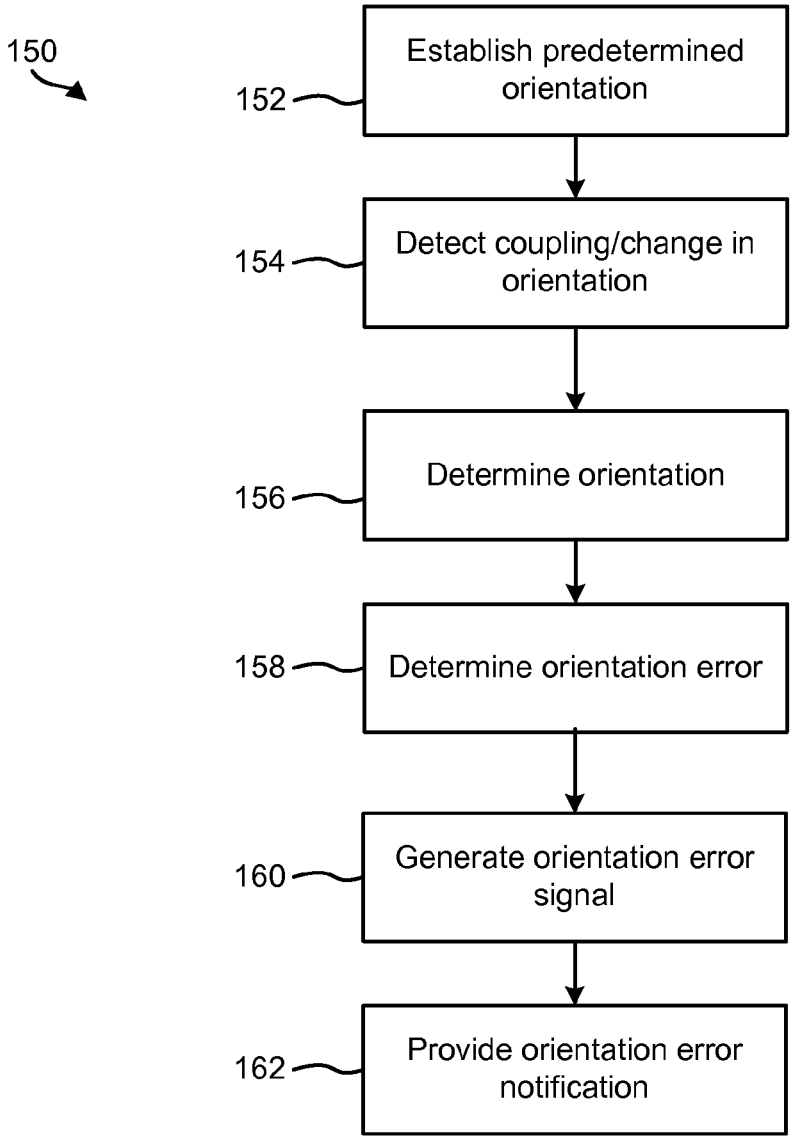
FIG. 3 is a flowchart showing a method for providing a notification of device orientation in accordance with an embodiment of the present disclosure.

Referring now to FIG. 3 and with further reference to the description above, one example method 150 is illustrated for providing a notification of device orientation. Generally, the method 150 may include one or more operations, functions, or actions as illustrated by one or more of blocks 152-162. Although the blocks 152-162 are illustrated in sequential order, these blocks may also be performed concurrently and/or in a different order than illustrated. The method 150 may also include additional or fewer blocks, as needed or desired. For example, the various blocks 152-162 can be combined into fewer blocks, divided into additional blocks, and/or removed based upon a desired implementation.

The method 150 can be implemented by the device 20 and components 22, 24 described above, for example. In the method 150, at block 152, the device 20 programs the processor 30 and/or 44 with a predetermined or desired orientation or range of orientations of the first component 22 with respect to the second component 24 and/or with respect to the person using the device 20 (or otherwise stores data relating to the predetermined orientation or range of orientations in the data storage 34 and/or 48). In one example, a clinician may establish the predetermined orientation during a fitting session to configure the device for the person. In another example, a user input while the device is in use may establish the predetermined orientation. The device 20 may also perform a machine-learning process that establishes and/or adjusts the predetermined orientation based on historical orientation information, which may include information related to prior user inputs to establish the predetermined orientation, prior fitting sessions to establish the predetermined orientation, and the like.

At block 154, the device 20 may perform a process to initiate various functions of the present disclosure. For example, at block 154, the device may detect that the first component 22 is coupled with the second component 24. In one example discussed above, the first component 22 may include a Hall sensor that can be used to detect the presence of a magnetic field generated by a magnet that is included in the second component 24. The detection of the magnetic field can be used as a switch to cause the processor 30 to initiate various functions, such as determining the orientation of the first component and determining the orientation error. In addition, at block 154, the device may detect a change in the orientation of the first component 22, which can be similarly used as a trigger to cause the processor 30 to initiate various functions.

Following block 154, at block 156, the device 22 determines an orientation of the first component 22 with respect to the person and/or the second component 24. The device 22 may use one or more sensors 38, 52 to determine the orientation of the first component, as discussed above. Then, at block 158, the device 20 is configured to compare the determined orientation of the first component with the predetermined orientation, and to determine an orientation error based on the comparison. At block 158, the device 20 can also determine an extent of orientation error between the determined orientation of the first component and the predetermined orientation.

The device 22, at block 160, may then generate an orientation error signal that represents the orientation error, and that may also be indicative of the extent of orientation error. As discussed above, the device 22 may adjust one or more attributes of the error signal in accordance with the extent of orientation error. At block 162, the device 22 applies the orientation error signal to stimulation electronics 46 to provide a notification to the person of the orientation error. As discussed above, the notification can be perceived by the person as sound. Thereafter, the person can adjust the orientation of the first component, and the device 22 can provide additional notifications of the orientation error to assist the person to position the first component in the predetermined orientation. As discussed above, when the first component has been moved to the predetermined orientation, the device 22 can provide another, different notification that the first component is in the predetermined orientation.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. A hearing prosthesis, comprising:

a first component, which includes:

a housing, wherein the housing has a substantially symmetrical shape;

a magnet that couples the first component to a separate second component;

a microphone;

a sensor that generates a first signal that is indicative of an orientation of the microphone; and a processor that uses the first signal to determine if the microphone is in a predetermined orientation, wherein the processor, responsive to determining that the microphone is not in the predetermined orientation, generates a second signal that is used to provide a notification that the microphone is not in the predetermined orientation, wherein the microphone, the sensor, and the magnet are disposed within the housing; and a second component, which includes:

an actuator that uses the second signal to generate an output that provides the notification that the microphone is not in the predetermined position, and wherein the output generated by the actuator is perceivable as sound and is selected from the group consisting of an audible sound, a vibration, and an electrical signal.

2. The hearing prosthesis of claim 1, wherein the processor uses the first signal to determine an extent of orientation error between the orientation of the microphone and the predetermined orientation, and wherein the second signal is adapted to provide a notification that is indicative of the extent of orientation error.

3. The hearing prosthesis of claim 2, wherein the processor sets one or more attributes of the second signal in accordance with the extent of orientation error, wherein the second signal with the set one or more attributes is adapted to be used by the actuator to generate the output that is indicative of the extent of orientation error and that is perceivable as sound.

4. The hearing prosthesis of claim 1, wherein the first component includes a second sensor that generates a third signal that is indicative of whether the first component is coupled to the second component, wherein the processor uses the third signal to determine whether the first component is coupled to the second component, and wherein the processor, responsive to determining that the first component is coupled to the second component, uses the first signal to determine if the microphone is in the predetermined orientation.

5. The hearing prosthesis of claim 1, wherein the sensor is selected from the group consisting of an accelerometer, a gyroscope, a hall sensor, a tilt sensor, an inductor, a light sensor, a polarized antenna, and a proximity sensor.

6. A method comprising:

determining, by a medical device, that a first component of the medical device is coupled with a second component of the medical device;

responsive to determining that the first component is coupled with the second component, determining, by the medical device, an orientation of the first component with respect to the second component;

determining, by the medical device, an orientation error between the determined orientation of the first component with respect to the second component and a predetermined orientation of the first component with respect to the second component; and generating, by the medical device, an error signal that is indicative of the orientation error.

7. The method of claim 6, further comprising using, by an actuator of the medical device, the error signal to generate an output that is indicative of the orientation error, wherein the output can be perceived as sound.

8. The method of claim 6, further comprising determining, by the medical device, an extent of orientation error between the determined orientation of the first component with respect to the second component and the predetermined orientation of the first component with respect to the second component, wherein the medical device generates the error signal to be indicative of the extent of orientation error, and further comprising using, by an actuator of the medical device, the error signal to generate an output that is indicative of the extent of orientation error, wherein the output can be perceived as sound.

9. The method of claim 8, further comprising setting, by the medical device, at least one of a pattern, amplitude, or frequency of the error signal, wherein at least one of the pattern, amplitude, or frequency of the error signal is indicative of the extent of orientation error.

10. The method of claim 6, wherein the medical device is a hearing prosthesis, wherein the first component includes a directionally-sensitive microphone, and wherein the orientation of the first component with respect to the second component is based on the orientation of the directionally-sensitive microphone with respect to the second component.

11. The method of claim 10, further comprising generating, by the medical device, a confirmation signal in response to the medical device determining that the orientation of the first component matches the predetermined orientation, and using, by an actuator of the medical device, the confirmation signal to generate a second output that is indicative of the determination that the orientation of the first component matches the predetermined orientation, wherein the second output can be perceived as sound.

12. The method of claim 6, further comprising detecting, by the medical device, a changed orientation of the first component with respect to the second component, and responsive to detecting the changed orientation, the medical device determining a second orientation error between the changed orientation of the first component with respect to the second component and the predetermined orientation of the first component with respect to the second component, and generating, by the medical device, a second error signal that is indicative of the second orientation error.

13. The method of claim 6, further comprising determining the predetermined orientation of the first component with respect to the second component, wherein determining the predetermined orientation includes a step selected from the group consisting of determining, by a clinician, the predetermined orientation during a medical device configuration process, determining, by the medical device, the predetermined orientation according a machine-learning process, and determining, by a user, the predetermined orientation according to a user input.

14. A hearing prosthesis comprising:

a first component that includes a microphone, a sensor, and a processor; and a second component that includes an actuator, wherein the sensor is configured to generate a first signal that is indicative of an orientation of the first component, wherein the processor is configured to use the first signal to determine if the first component is in a predetermined orientation, wherein the processor is configured to, responsive to determining that the microphone is not in the predetermined orientation, generate a second signal that is indicative of an orientation error between the orientation of the microphone and the predetermined orientation, wherein the actuator is configured to use the second signal to generate an output that can be perceived as sound, and wherein the output generated by the actuator includes at least one of audible sounds, vibrations, or electrical signals, wherein the first component is configured to detect whether the first component is coupled with the second component, and wherein the processor is configured to, responsive to detecting that the first component is coupled to the second component, use the first signal to determine if the microphone is in the predetermined orientation.

15. The hearing prosthesis of claim 14, wherein the processor is configured to use the first signal to determine an extent of orientation error between the orientation of the first component and the predetermined orientation, wherein the processor is configured to vary one or more of a signal pattern, signal amplitude, or signal frequency of the second signal in accordance with the extent of orientation error, and wherein the actuator is configured to use the second signal to generate the output that is indicative of the extent of orientation error.

16. The hearing prosthesis of claim 14, wherein the predetermined orientation is defined at least in part by the microphone facing in a forward direction with respect to a recipient of the hearing prosthesis.

17. A medical device, comprising:

a second component;

a first component, comprising a processor configured to:

determining that the first component is coupled with the second component of the medical device;

responsive to determining that the first component is coupled with the second component, determine an orientation of the first component with respect to the second component;

determine an orientation error between the determined orientation of the first component with respect to the second component and a predetermined orientation of the first component with respect to the second component; and cause the medical device to generate an error signal that is indicative of the orientation error.

18. The medical device of claim 17, further comprising an actuator configured to use the error signal to generate an output that is indicative of the orientation error, wherein the output can be perceived as sound.

19. The medical device of claim 18, wherein the processor is further configured to determine an extent of orientation error between the determined orientation of the first component with respect to the second component and the predetermined orientation of the first component with respect to the second component, wherein the medical device generates the error signal to be indicative of the extent of orientation error.

20. The medical device of claim 19, wherein the medical device is configured to set at least one of a pattern, amplitude, or frequency of the error signal, wherein at least one of the pattern, amplitude, or frequency of the error signal is indicative of the extent of orientation error.

21. The medical device of claim 17, wherein the medical device is a hearing prosthesis, wherein the first component includes a directionally-sensitive microphone, and wherein the orientation of the first component with respect to the second component is based on the orientation of the directionally-sensitive microphone with respect to the second component.

22. The medical device of claim 21, wherein the medical device is configured to generate a confirmation signal in response to a determination that the orientation of the first component matches the predetermined orientation, and further comprising actuator configured to use the confirmation signal to generate a second output that is indicative of the determination that the orientation of the first component matches the predetermined orientation, wherein the second output can be perceived as sound.

23. The medical device of claim 17, wherein the processor is configured to detect a changed orientation of the first component with respect to the second component, and responsive to a detection of the changed orientation, the medical device is configured to determine a second orientation error between the changed orientation of the first component with respect to the second component and the predetermined orientation of the first component with respect to the second component, and generate a second error signal that is indicative of the second orientation error.

* * * * *